US010096939B2

(12) United States Patent
Chikusa et al.

(10) Patent No.: US 10,096,939 B2
(45) Date of Patent: Oct. 9, 2018

(54) CONNECTOR

(71) Applicant: Sumitomo Wiring Systems, Ltd., Yokkaichi, Mie (JP)

(72) Inventors: Takahiro Chikusa, Mie (JP); Shinji Iihoshi, Mie (JP)

(73) Assignee: Sumitomo Wiring Systems, LTD., Yokkaichi (JP)

( * ) Notice: Subject to any disclaimer, the term of this patent is extended or adjusted under 35 U.S.C. 154(b) by 0 days.

(21) Appl. No.: 15/608,108

(22) Filed: May 30, 2017

(65) Prior Publication Data

US 2017/0346221 A1 Nov. 30, 2017

(30) Foreign Application Priority Data

May 30, 2016 (JP) ..... 2016-107549

(51) Int. Cl.

| | |
|---|---|
| ***H01R 13/62*** | (2006.01) |
| ***H01R 13/629*** | (2006.01) |
| ***H01R 13/28*** | (2006.01) |
| ***H01R 13/428*** | (2006.01) |
| ***H01R 13/642*** | (2006.01) |

(52) U.S. Cl.

CPC ..... *H01R 13/62911* (2013.01); *H01R 13/28* (2013.01); *H01R 13/428* (2013.01); *H01R 13/62977* (2013.01); *H01R 13/62983* (2013.01); *H01R 13/642* (2013.01); *H01R 13/62938* (2013.01)

(58) Field of Classification Search

CPC ..... H01R 13/62938; H01R 13/62955; H01R 13/62933; H01R 13/62905; H01R 13/6275; H01R 23/7005

USPC ..... 439/157, 372, 347, 259, 266

See application file for complete search history.

(56) References Cited

U.S. PATENT DOCUMENTS

| | | | | |
|---|---|---|---|---|
| 4,586,771 A * | 5/1986 | Kraemer | H01R 13/62911 | 439/157 |
| 5,445,530 A * | 8/1995 | Inoue | H01R 13/62938 | 439/157 |
| 5,873,745 A * | 2/1999 | Duclos | H01R 13/62944 | 439/157 |
| 6,461,177 B1 * | 10/2002 | Saka | H01R 13/4362 | 439/157 |

(Continued)

FOREIGN PATENT DOCUMENTS

JP 2003-151682 5/2003

*Primary Examiner* — Hien Vu

(74) *Attorney, Agent, or Firm* — Gerald E. Hespos; Michael J. Porco; Matthew T. Hespos

(57) ABSTRACT

It is aimed to provide a connector capable of suppressing opening deformation of an operating member and avoiding enlargement. A U-shaped operating member (11) is arranged to straddle a housing (10) and is linearly movable from an initial position to a connection position while arms (37) slide on the housing (10) and proceeds with a connecting operation of the housing (10) and a mating housing (12) by cam engagement of the arms (37) with the mating housing (12) during a movement. The housing (10) includes support shafts (18) and the arms (37) include linearly extending long grooves (39) into which the support shafts (18) are inserted to be slidable in contact therewith. The support shaft (18) includes jaws (19) and the long groove (39) includes an engaging edge (44) configured to contact the jaws (19) in an opening direction of the arm (37).

7 Claims, 16 Drawing Sheets

(56) References Cited

U.S. PATENT DOCUMENTS

| | | | | |
|---|---|---|---|---|
| 9,160,108 | B2 * | 10/2015 | Kamiya ..... | H01R 13/62938 |
| 2005/0221653 | A1 * | 10/2005 | Dillon ..... | H01R 13/62977<br>439/331 |

* cited by examiner

CONNECTOR

BACKGROUND

1. Field of the Invention

The invention relates to a connector.

2. Description of the Related Art

Japanese Unexamined Patent Publication No. 2003-151682 discloses a connector with male and female housings that are connectable to each other, and a slider movably mounted on the female housing. The slider includes a coupling plate and two sliding plates to define a U-shape. The sliding plate has a cam groove. The male housing includes a receptacle, and follower pins stand on outer surfaces of the receptacle. The female housing includes a tower, a skirt arranged on the outer periphery of the tower, and covers arranged at upper and lower sides of the skirt. Insertion paths are provided between the covers and the skirt for receiving the sliding plates of the slider.

Prior to the connection of the housings, the sliding plates are inserted laterally into the insertion paths and the slider is held at a retracted position. Subsequently, the receptacle is fit shallowly between the skirt and the tower of the female housing so that the follower pins enter the entrances of the cam grooves. The slider then is pushed toward an advanced position. Thus, the follower pins slide along edges of the cam grooves, and a cam mechanism acts between the slider and the male housing so that a connecting operation of the housings proceeds. The housings are connected properly when the slider reaches the advanced position and the follower pins reach ends of the cam grooves.

The sliding plates of the above-described U-shaped slider are urged out and away from one another upon receiving connection resistance of the housings in a moving process. Expanding movements of the sliding plates are restricted by the covers that cover outer sides of the sliding plates. However, the housing is enlarged outwardly by as much as the covers and it is not possible to meet a request for connector miniaturization.

The invention was completed based on the above situation and aims to provide a connector capable of suppressing opening deformation of an operating member configured to linearly move with respect to a housing and avoiding enlargement.

SUMMARY

The invention relates to a connector with a housing connectable to a mating housing. The connector has an operating member with a coupling portion and two arms projecting from the coupling portion to define a U-shape that straddles the housing. The operating member is linearly movable from an initial position to a connection position while the arms slide on the housing. The arms are configured to engage the mating housing and to generate a cam action that urges the housing and the mating housing toward or away from each other as the operating member moves on the housing. One of the housing and the arms has a support shaft and the other has a long linear groove. The support shaft is inserted into the long groove and slides in contact with the long groove. The support shaft includes a jaw and the long groove includes an engaging edge configured to contact the jaw in an opening direction of the arm.

When the operating member linearly moves with respect to the housing, the long grooves and the support shafts slide on each other to guide a movement of the operating member. Expanding movements (opening deformations) of the arms are suppressed by the contact of the engaging edges of the long grooves with the jaws of the support shafts. Thus, the long grooves and the support shafts perform a function of guiding the movement of the operating member and also perform a function of restricting opening deformation. Members, such as covers to cover the arms of the operating member (see Japanese Unexamined Patent Publication No. 2003-151682) are not necessary outside the housing. Thus, enlargement of the connector can be avoided. Note that an operating member of an embodiment to be described later has an assembled position beside the initial position and the connection position. However, in the case of the present invention, the operating member may not have the assembled position.

The operating member may be arranged in an exposed manner on an outer surface without being covered by the housing. Accordingly, no member is required to cover the outside of the operating member, and enlargement of the connector is avoided

DETAILED DESCRIPTION

One embodiment of the invention is described with reference to FIGS. 1 to 16. A connector of this embodiment includes a housing 10 and an operating member 11. The housing 10 is connectable to a mating housing 12. Note that, in the following description, surfaces of the housings 10, 12 facing each other at the start of connection are referred to as front ends concerning a front-rear direction. A vertical direction is based on FIG. 13 and equivalent to a direction perpendicular to the plane of FIG. 1. Further, a lateral direction is based on FIG. 1.

Figure 2:
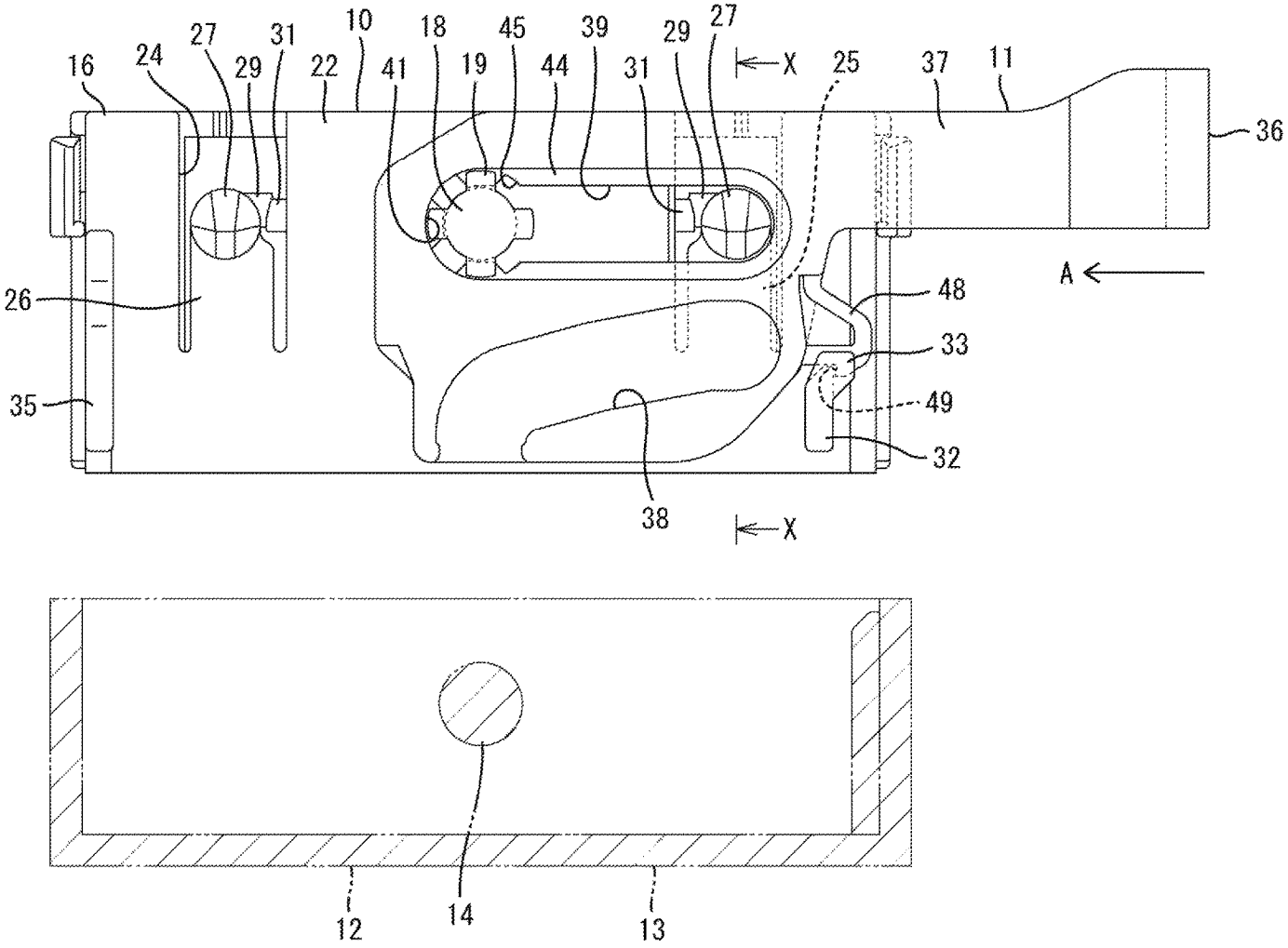
FIG. 2 is a plan view showing a state where the operating member is arranged at an initial position with respect to the housing and facing a mating housing.

The mating housing 12 is made of synthetic resin and includes a rectangular tubular receptacle 13 that is long and narrow in the lateral direction, as shown in FIG. 2 Cylindrical cam followers 14 project on laterally central parts of inner surfaces of upper and lower walls. A rib-like unlocking portion 15 is provided on one lateral end part of the inner surface of each of the upper and lower walls and extends in the front-rear direction. Tabs of unillustrated male terminal fittings project in the receptacle 13.

Figure 11:
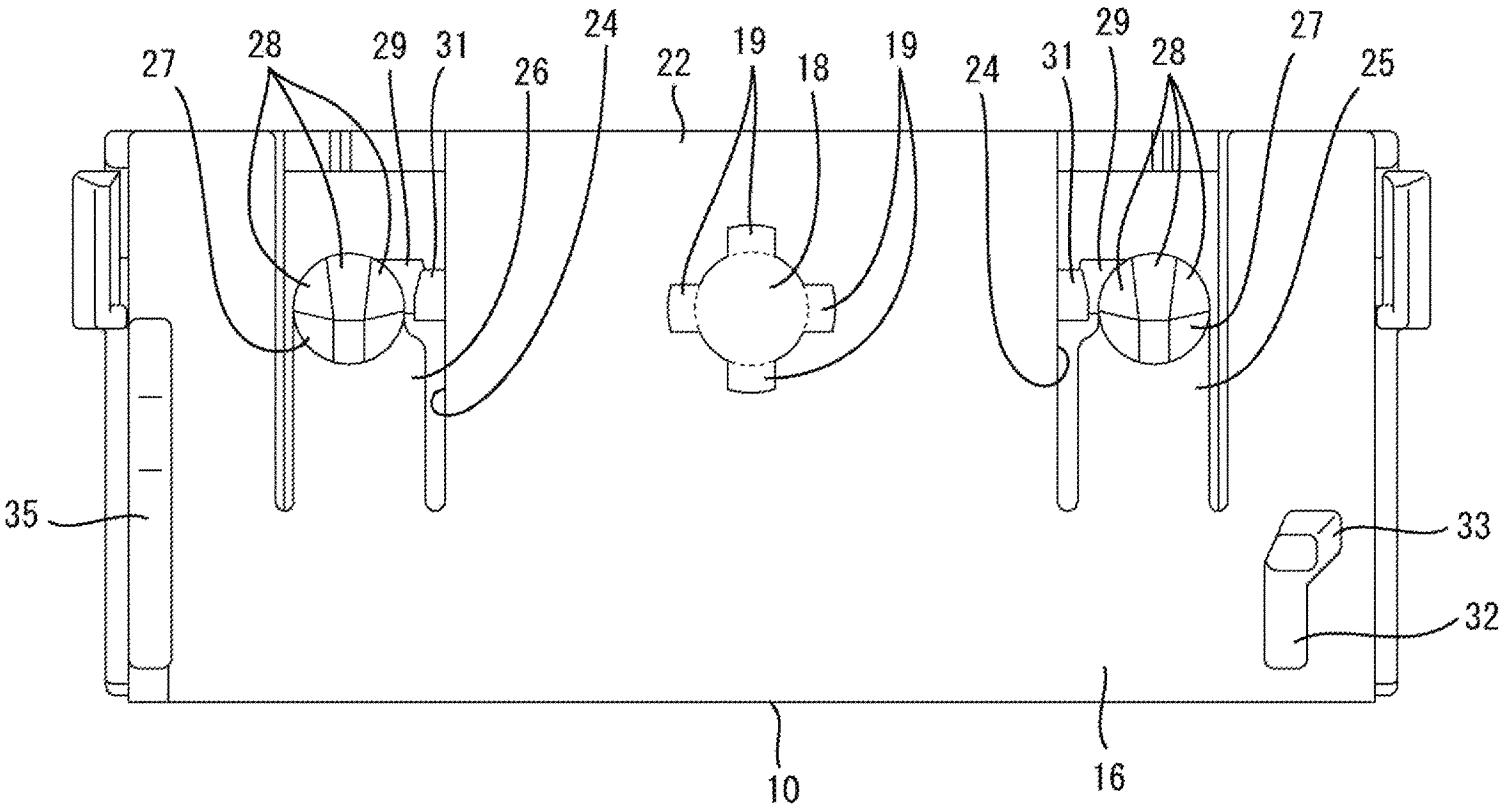
FIG. 11 is a plan view of the housing.
Figure 12:
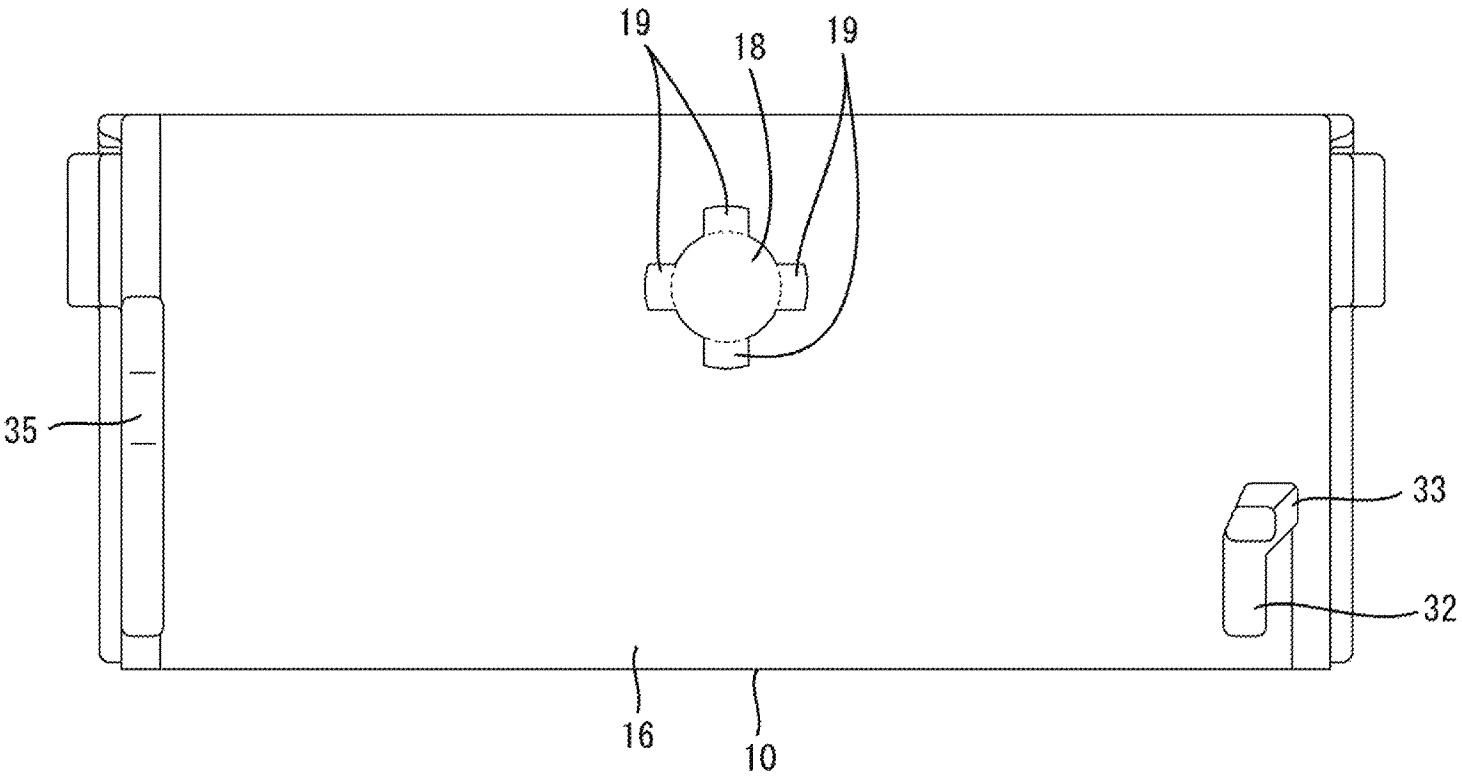
FIG. 12 is a bottom view of the housing.
Figure 13:
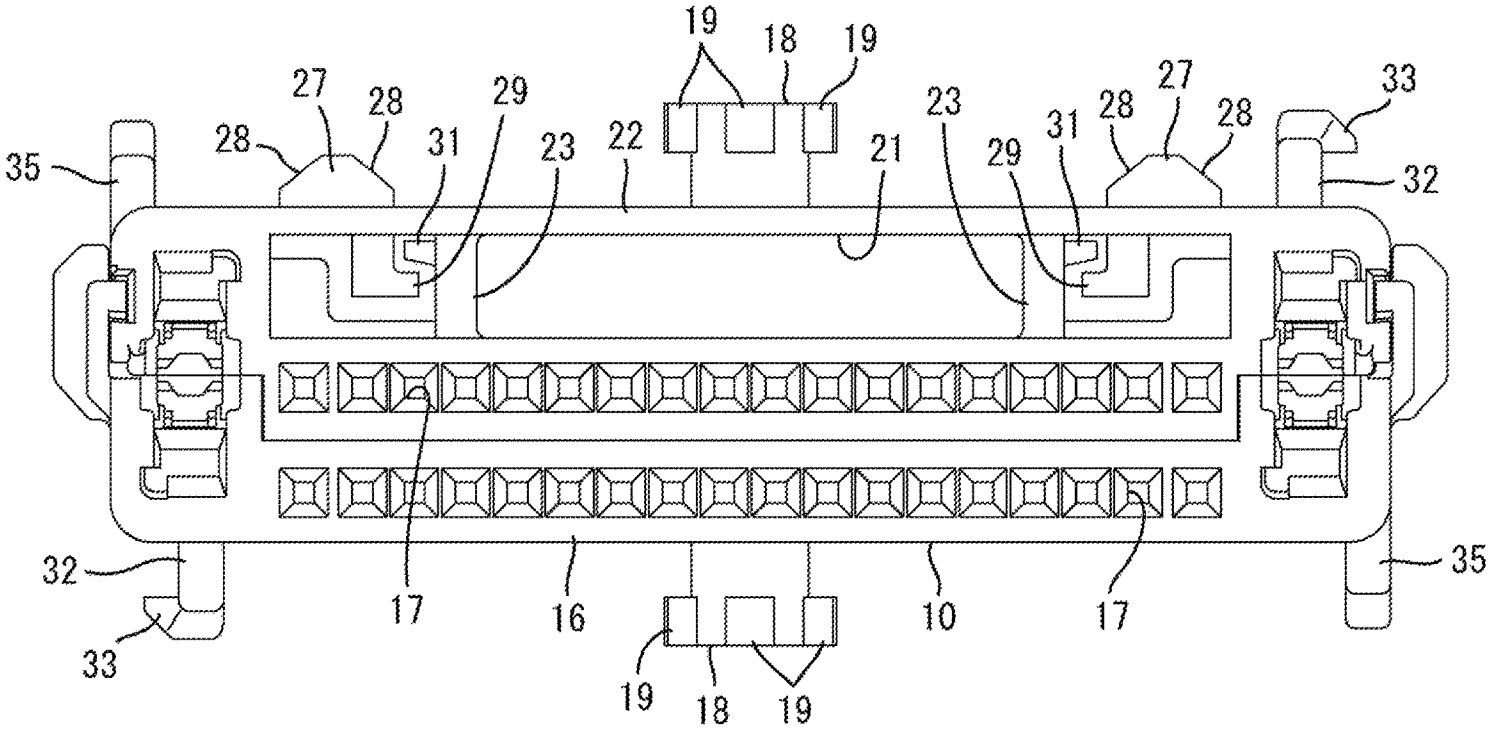
FIG. 13 is a front view of the housing.

The housing 10 is made of synthetic resin and includes a rectangular block-shaped housing body 16, as shown in FIGS. 11 to 13. The housing body 16 is a long in the lateral direction and can fit in the receptacle 13. Cavities 17 penetrate through the housing body 16 in the front-rear direction, as shown in FIG. 13. The cavities 17 are arranged side by side in a width direction in upper and lower stages, and unillustrated female terminal fittings are inserted and held therein. The female terminal fitting is crimped and connected to an end part of an unillustrated wire and is connected conductively to the mating male terminal fitting when the housings 10, 12 are connected properly.

Cylindrical support shafts 18 project in laterally central parts of upper and lower surfaces (surfaces along a long side direction) of the housing body 16. Each support shaft 18 includes jaws 19 that protrude radially from a tip area of a cylindrical part. The jaws 19 are on the tip area of the cylindrical part while being spaced apart in a circumferential direction. Specifically, the jaws 19 are rectangular in a plan view and are arranged at intervals of 90° to the front, rear, left and right of the tip part of the cylindrical part.

As shown in FIG. 13, a flat laterally-extending space 21 penetrates in the front-rear direction through an upper end part of the housing body 16 above the respective cavities 17, and a flat plate-like thin wall 22 extends laterally to close an upper side of the space 21. The interior of the space 21 is divided by separation walls 23 on left and right sides.

As shown in FIG. 11, cutout grooves 24 are provided on left and right end parts of the thin wall 22. The grooves 24 extend in the front-rear direction and open on a rear end while communicating with the space 21. An inner edge part of each cutout groove 24 is continuous with a surface of the separation wall 23. Plate pieces are provided inside the grooves 24 on left and right ends of the thin wall 22 and are cantilevered rearward from front ends to define resilient locks 25, 26 that are deflectable and deformable in the vertical direction with the front ends serving as supports.

As described later, the resilient locks 25, 26 function to lock and hold the operating member 11 on the housing 10 in a movement restricted state, and are composed of a first lock 25 (right side of FIG. 11) and a second lock 26 (left side of FIG. 11). The first and second locks 25, 26 are line-symmetrically shaped and are at line-symmetrical positions across a laterally central part of the housing body 16 where the support shafts 18 are located. Note that, in the following description, unless it is particularly necessary to distinguish the first and second locks 25, 26, the first and second locks 25, 26 are referred to collectively as the resilient locks 25, 26.

As shown in FIG. 11, rear ends of the plate pieces of the resilient locks 25, 26 are retracted forward from the rear end of the housing 10. Lock projections 27 project up on rear tip parts of the plate pieces of the resilient locks 25, 26. Each lock projection 27 is circular in a plan view and has tapered slopes 28 inclined up toward a tip in a projecting direction on rear, left and right surfaces. The lock projections 27 are arranged laterally side by side at the same position as the support shafts 18 in the front-rear direction.

As shown in FIG. 13, excessive deflection restricting pieces 29 are provided on the tip parts of the plate pieces of the resilient locks 25, 26 and project down in the space 21. The excessive deflection restricting piece 29 is composed of a vertical part hanging down from the plate piece and a horizontal part bent at a right angle from the lower end of the vertical part toward the separation wall 23 to define an L-shaped in a front view.

An excessive deflection restriction receiving piece 31 projects above the horizontal part of the excessive deflection restricting piece 29 on the surface of the separation wall 23. The excessive deflection restriction receiving piece 31 is at a predetermined distance from and in parallel to the excessive deflection restricting piece 29. The resilient lock 25, 26 is deflected and deformed up and the excessive deflection restricting piece 29 comes into contact with the excessive deflection restriction receiving piece 31 from below, thereby restricting any further deflection of the resilient lock 25, 26. Thus, even if the resilient lock 25, 26 is caught by external matter, such as a looped wire, it is possible to avoid a situation where the resilient lock 25, 26 is turned out and broken. Note that, as shown in FIG. 11, a side edge part of a tip part of the resilient lock 25, 26 on the side of the separation wall 23 is cut due to the molding of the excessive deflection restriction receiving piece 31.

As shown in FIG. 13, a lock receiving portion 32 is provided on one lateral end of both upper and lower surfaces of the housing body 16. Two of the lock receiving portions 32 are point-symmetrically shaped and are arranged at point-symmetrical positions with respect to an axial center when the housing body 16 is viewed from the front. As shown in FIG. 11, each lock receiving portion 32 includes a rib-like part extending in the front-rear direction and is in front of and laterally to the resilient locks 25, 26 (right side of FIG. 11). A space into which the unlocking portion 15 of the mating housing 12 is inserted when the housings 10, 12 are connected is secured laterally to the lock receiving portion 32.

Figure 4:
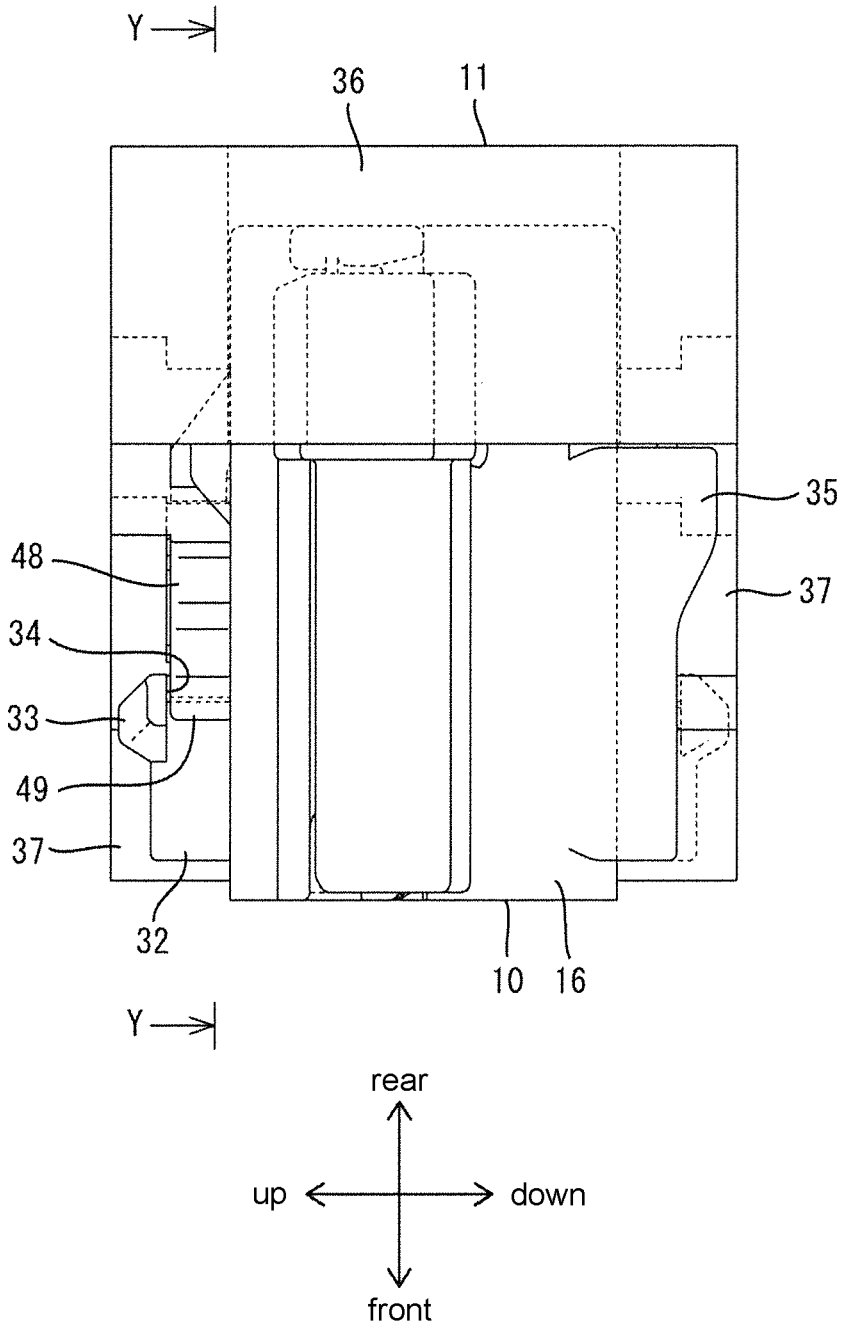
FIG. 4 is a side view showing the state where the operating member is arranged at the initial position with respect to the housing.

As shown in FIGS. 11 to 13, the lock receiving portion 32 has a receiving piece 33 bent to protrude rearward and laterally on a rear end of a tip of the rib-like part in a projecting direction. As shown in FIG. 4, an insertion recess 34 is defined between the receiving piece 33 and the rib-like part and receives a locking projection 49 of the operating member 11.

As shown in FIG. 13, stoppers 35 in the form of plate pieces extending in the front-rear direction are provided on the other lateral end part of each of the upper and lower surfaces of the housing body 16. The stoppers 35 are point-symmetrically shaped at point-symmetrical positions with respect to the center of the housing body 16. Additionally, the stoppers 35 are longer in the front-rear direction than the lock receiving portions 32 and are arranged on side surfaces of the housing body 16, as shown in FIG. 11. The rear end of the stopper 35 protrudes vertically and is arranged perpendicularly, as shown in FIG. 4. When the operating member 11 reaches an initial position, to be described later, the operating member 11 can be stopped in contact with the stopper 35.

Figure 15:
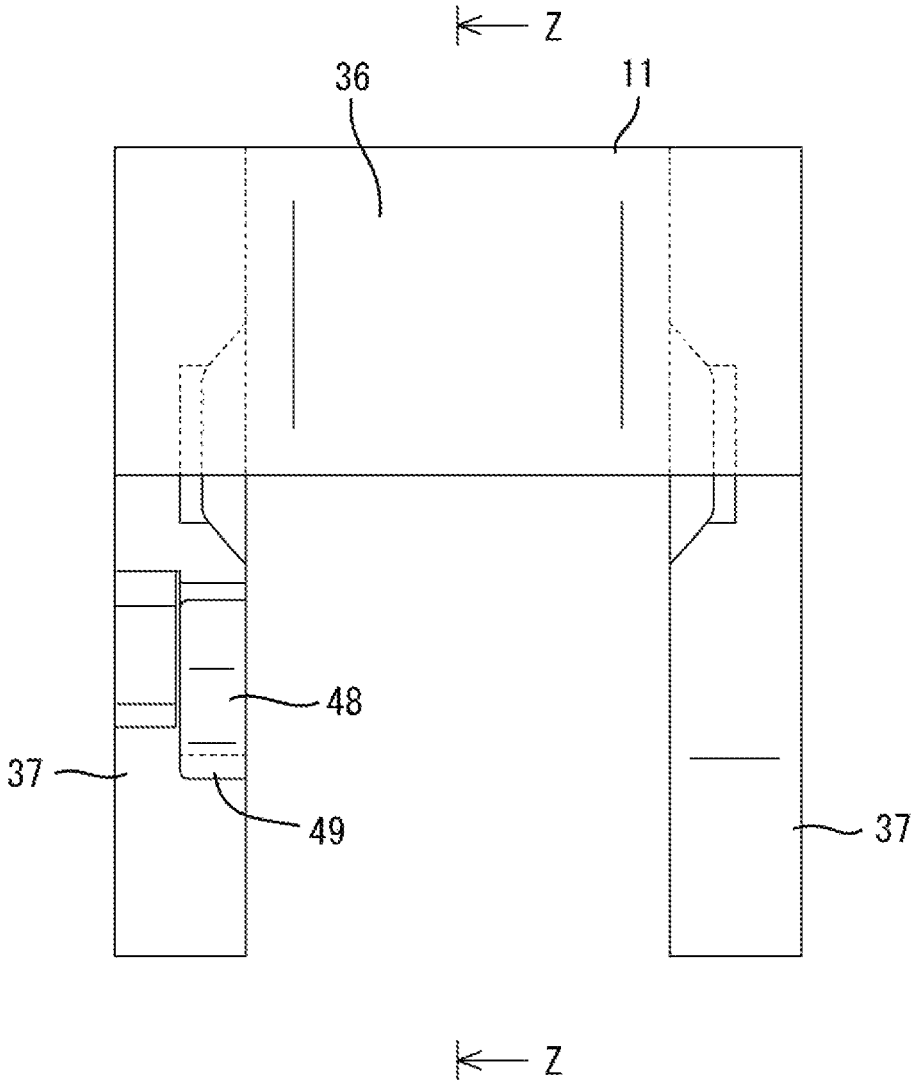
FIG. 15 is a side view of the operating member.
Figure 16:
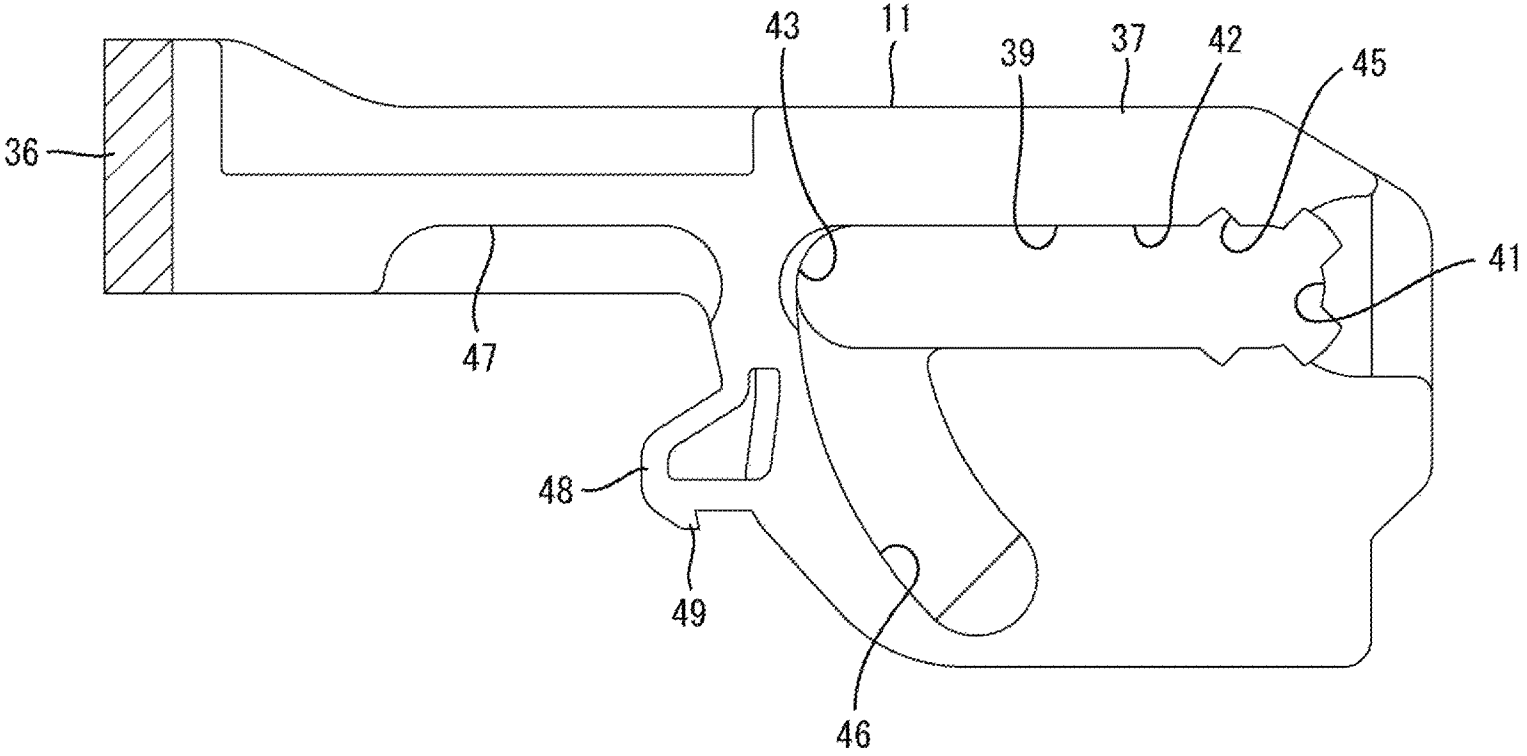
FIG. 16 is a section along Z-Z of FIG. 15.

The operating member 11 is made of synthetic resin, includes a coupling 36 and two arms 37 that project parallel to each other from ends of the coupling 36 to define a U-shape, as shown in FIG. 15. The operating member 11 is successively displaceable, with respect to the housing 10, to an assembled position (see FIG. 1) where the arms 37 project obliquely rearward at an angle of inclination of about 45° with respect to the front-rear direction and the lateral direction, the initial position (see FIG. 2) where the arms 37 project laterally of the housing 10 along the lateral direction and a connection position (see FIG. 8) where the arms 37 project slightly laterally of the housing 10 along the lateral direction or are arranged substantially without projecting.

The operating member 11 includes a rotating mechanism configured to rotationally displace the operating member 11 from the assembled position to the initial position with respect to the housing 10 to gradually increase a laterally projecting amount toward the initial position and a sliding mechanism configured to linearly move and displace the operating member 11 in the lateral direction along the housing 10 from the initial position to the connection position to gradually decrease the laterally projecting amount toward the connection position. Further, a movement path of the operating member 11 can be selected from a first movement path (see an arrow A of FIG. 2) along which the operating member 11 moves from the side of the first lock 25 toward the side of the second lock 26 and a second movement path (see an arrow B of FIG. 9) along which the operating member 11 vertically inverted from a moving posture along the first movement path moves from the side of the second lock 26 toward the side of the first lock 25 when the operating member 11 is moved toward the connection position by the sliding mechanism.

The coupling 36 is a plate piece extending in the vertical direction and an operator can grip the coupling portion 36 by the fingers.

Figure 14:
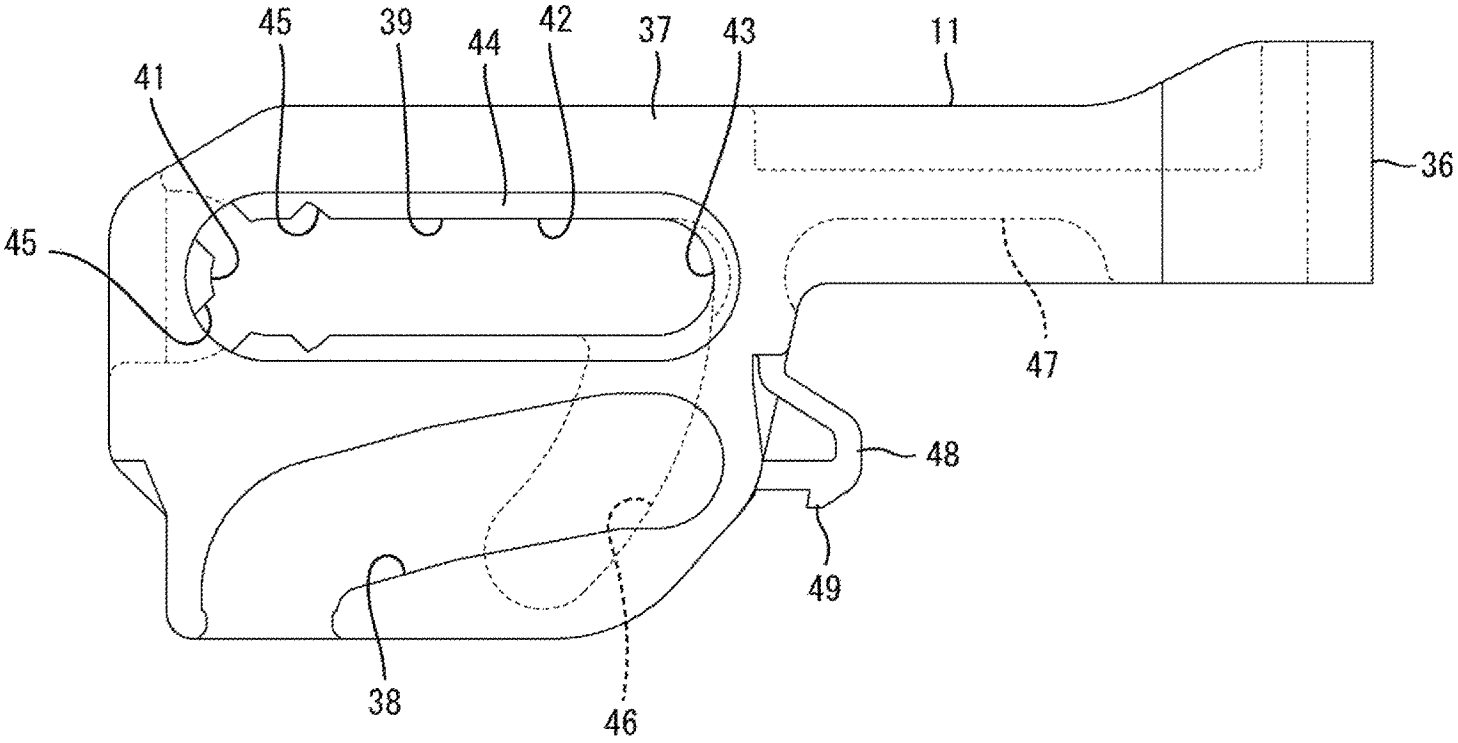
FIG. 14 is a plan view of the operating member.

As shown in FIG. 14, a side of each of the arms 37 distant from the coupling portion 36 defines a body in the form of a flat plate expanded in the front-rear direction, and a cam groove 38 is provided in the body. The cam groove 38 is a curved bottomed groove formed by recessing an outer surface of the body of the arm 37 that is open on the front end edge of the body. The cam groove 38 is engaged with the cam follower 14 of the mating housing 12 to generate the connecting operation of the housings 10, 12 when the operating member 11 moves between the initial position and the connection position.

A linearly extending long groove 39 is provided in an area of the body of each of the arms 37 behind the cam groove 38. The long groove 39 penetrates through the arm 37 in a plate thickness direction and is arranged along the lateral direction when the operating member 11 is at the initial position and the connection position. The support shaft 18 is inserted into the long groove 39 and slides in contact with an engaging edge 44 of the long groove 39 to guide a moving operation of the operating member 11 when the operating member 11 moves between the initial position and the connection position.

Figure 8:
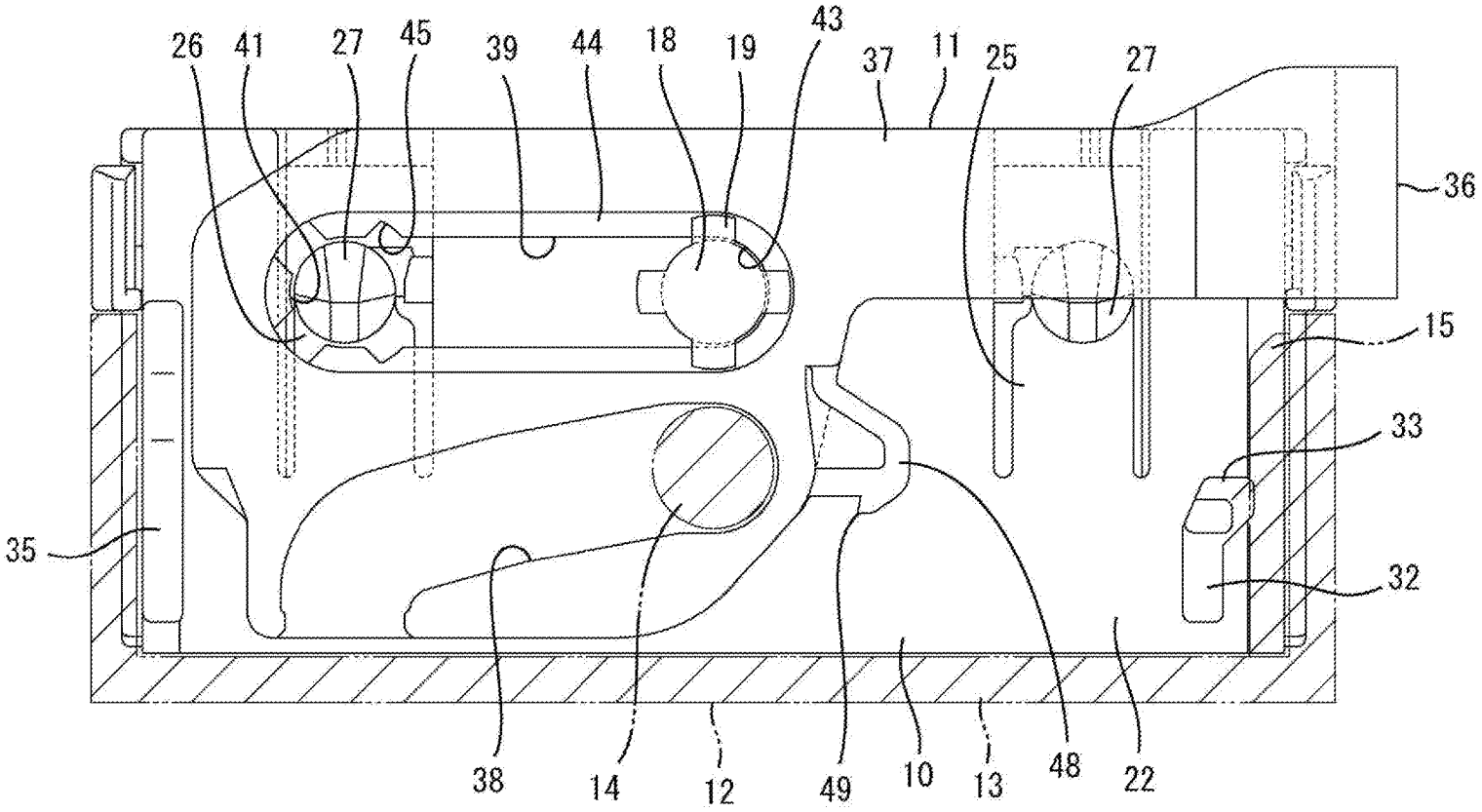
FIG. 8 is a plan view showing the state where the operating member is arranged at the connection position with respect to the housing.
Figure 9:
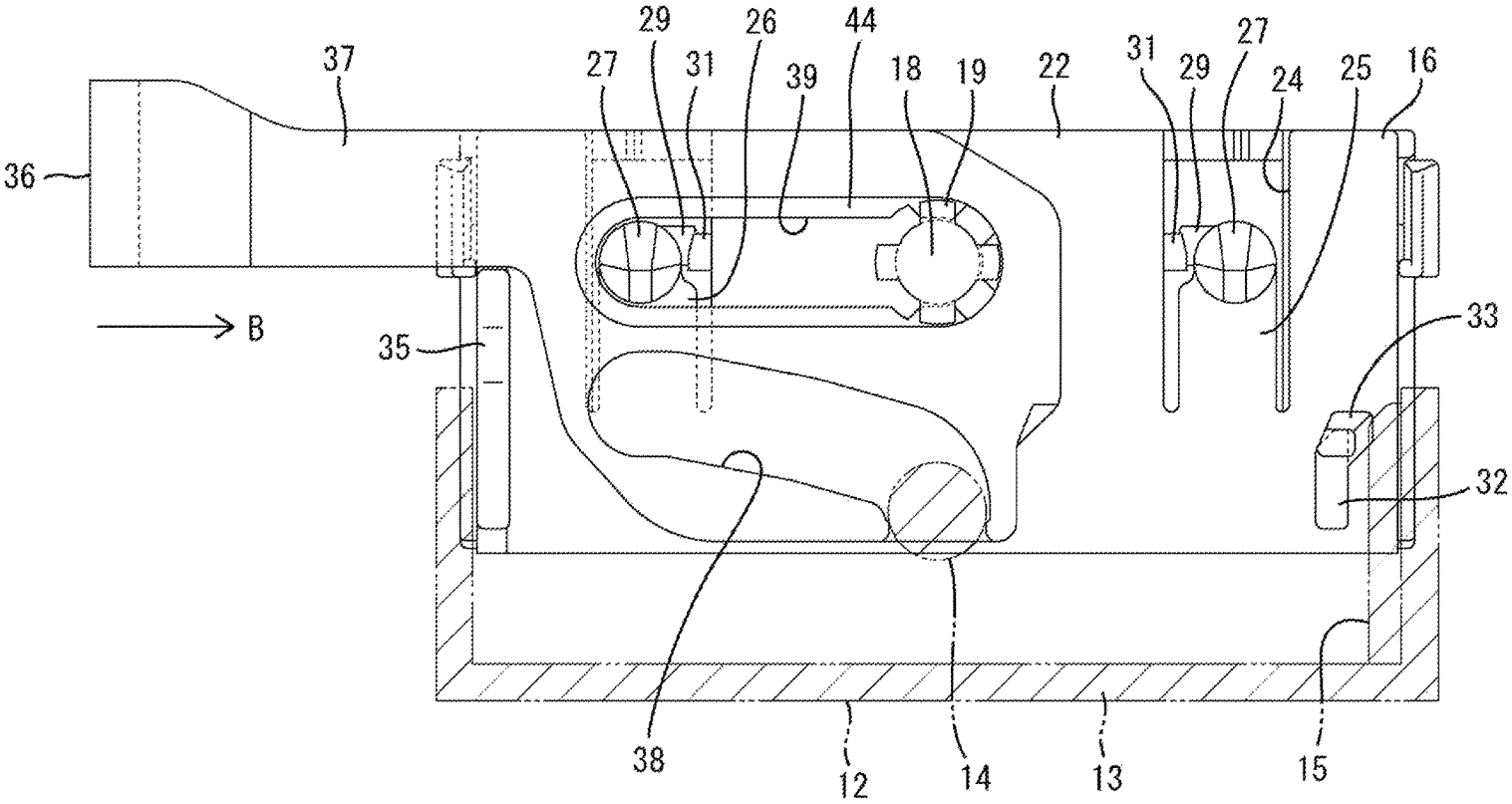
FIG. 9 is a plan view showing a state where the operating member is arranged at the initial position in an orientation opposite to that in FIG. 2 with respect to the housing.
Figure 10:
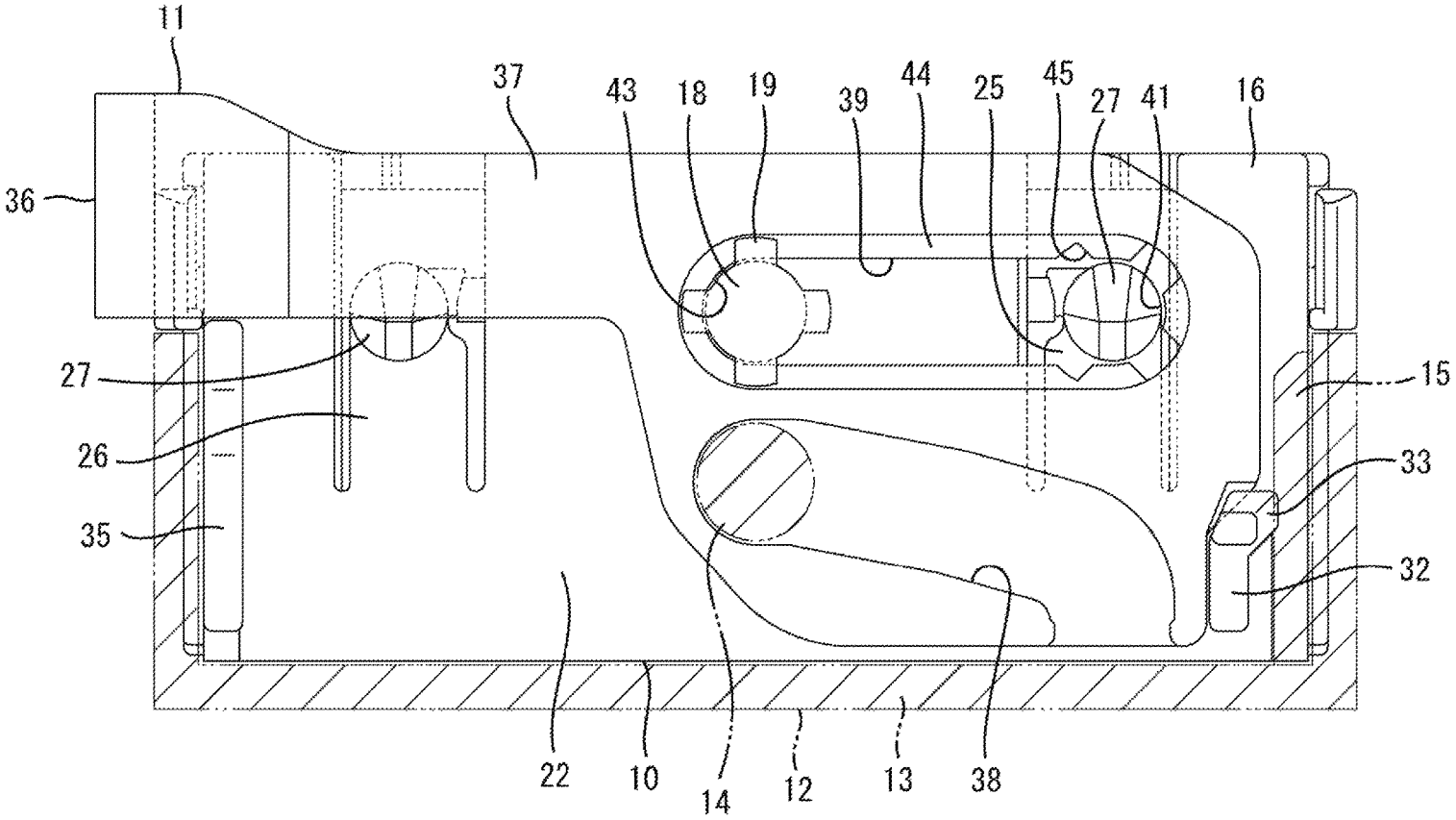
FIG. 10 is a plan view showing a state where the operating member is arranged at the connection position in an orientation opposite to that in FIG. 8 with respect to the housing.

The long groove 39 receives the support shaft 18 at an end 41 distant from the coupling 36 (see FIG. 1) and can slide in contact with the support shaft 18 in an extending portion 42 linearly extending from the end 41 toward the coupling 36. The engaging edge 44 is provided on an inner part (part on the side of the housing body 16) of the edge of the long groove 39 in the plate thickness direction of the arm 37 and protrudes over the entire periphery except at escaping recesses 45 to be described later. As shown in FIG. 8, the engaging edge 44 protrudes slightly less than the jaws 19 of the support shaft 18. This engaging edge 44 slides in contact with the jaws 19 of the support shaft 18 inserted into the long groove 39 from inside except at the initial position and acts to restrict outward expanding opening deformation of the arm 37.

Figure 1:
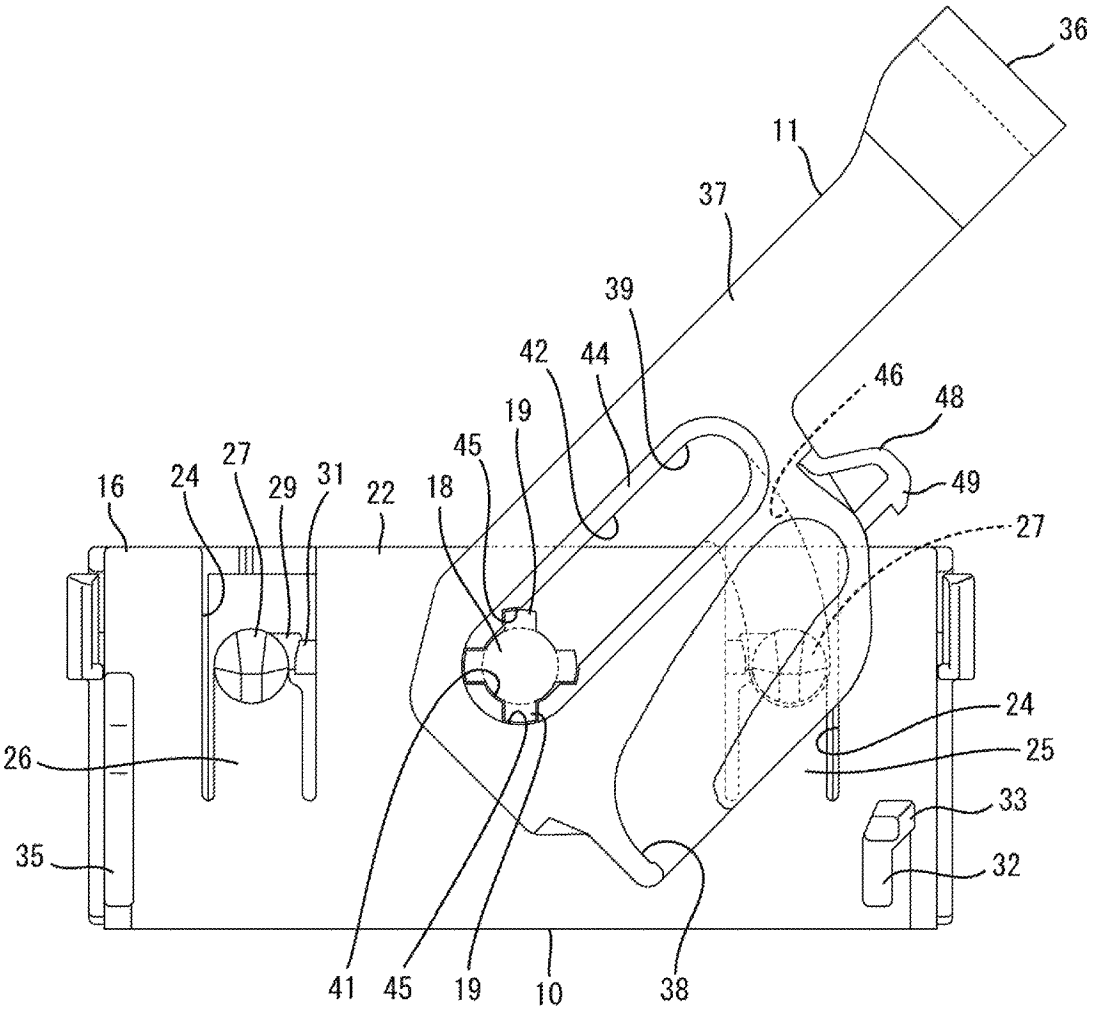
FIG. 1 is a plan view of a connector of one embodiment of the present invention showing a state where an operating member is arranged at an assembled position with respect to a housing.

As shown in FIGS. 1 and 14, the end portion 41 of the long groove 39 is provided with the escaping recesses 45 by partially cutting off the engaging edge 44. The escaping recesses 45 have such a rectangular or triangular cross-sectional shape that the jaws 19 can fit inside. When the operating member 11 is at the assembled position and the arms 37 are oriented to be obliquely inclined at 45°, the escaping recesses 45 are open at intervals of 90° on front, rear, left and right sides of the engaging edge 44.

As shown in FIG. the guide groove 46 is provided on the inner surface of the body of each of the arm portions 37 and is shallower than the cam groove 38. The lock projection 27 of the resilient lock 25, 26 is inserted into the guide groove 46 and slides in contact with the guide groove 46 when the operating member 11 is rotated between the assembled position and the initial position. The guide groove 46 is curved along an arc centered on a center of rotation of the operating member 11.

A bottomed escaping groove 47 is provided in an inner surface of a plate piece that connects the body and the coupling 36 in each of the arms 37. The escaping groove 47 is at the same position as the long groove 39 in the front-rear direction, extends laterally and is open on the front edge of the plate piece of the arm 37. The lock projection 27 of the resilient lock 25, 26 is inserted into the escaping groove 47 to escape when the operating member 11 moves between the initial position and the connection position.

A resilient piece 48 is provided on one 37 of the arms 37 projecting laterally (toward a side where the coupling 36 is located) along a plate surface of the arm 37 from an outer edge of the body. The resilient piece 48 is in the form of a beam supported on both ends coupled to the body of the arm 37, thinner than the body of the arm 37 and is curved into a U shape. The claw-like locking projection 49 projects forward on a tip part (U-shaped central part) of the resilient piece 48 in a projecting direction.

Next, functions of the connector are described.

The operating member 11 can be transported to a connector connecting operation site in a state where the operating member 11 and the housing 10 are separated without the operating member 11 being mounted on the housing 10. At the connecting operation site, the terminal fittings are inserted into the cavities 17 of the housing 10 and, subsequently, the operating member 11 is assembled with the housing 10 at the assembled position (see FIG. 1). In assembling, the operating member 11 is pushed to straddle the housing 10 from an oblique rear side. Then, after the both arms 37 are expanded, the escaping recesses 45 of the long grooves 39 pass through the jaws 19 of the support shafts 18 and the support shafts 18 are fit into the ends 41 of the long grooves 39.

When the operating member 11 reaches the assembled position, the lock projection 27 of the first lock 25 is inserted into the guide groove 46 of the arm 37. At this time, the lock projection 27 contacts a front end part of the guide groove 46, thereby restricting a rotational displacement of the operating member 11 in a direction opposite to that toward the initial position (see FIG. 1). Note that the operator can continuously perform a series of operations while gripping the coupling 36 of the operating member 11.

Subsequently, the operating member 11 is rotated clockwise in FIG. 1 from the assembled position toward the initial position about the support shafts 18 inserted into the ends 41 of the long grooves 39. While the operating member 11 is rotated, the rear slope 28 of the lock projection 27 slides in contact with the back surface of the guide groove 36 and the first lock 25 is deflected and deformed. Large resistance is not applied to the operating member 11 from the side of the housing 10. Further, as the operating member 11 is rotated from the assembled position toward the initial position, the engaging edges 44 of the long grooves 39 slide in contact with the jaws 19 of the support shafts 18 from inside, thereby restricting the detachment of the arms 37 from the support shafts 18.

Figure 3:
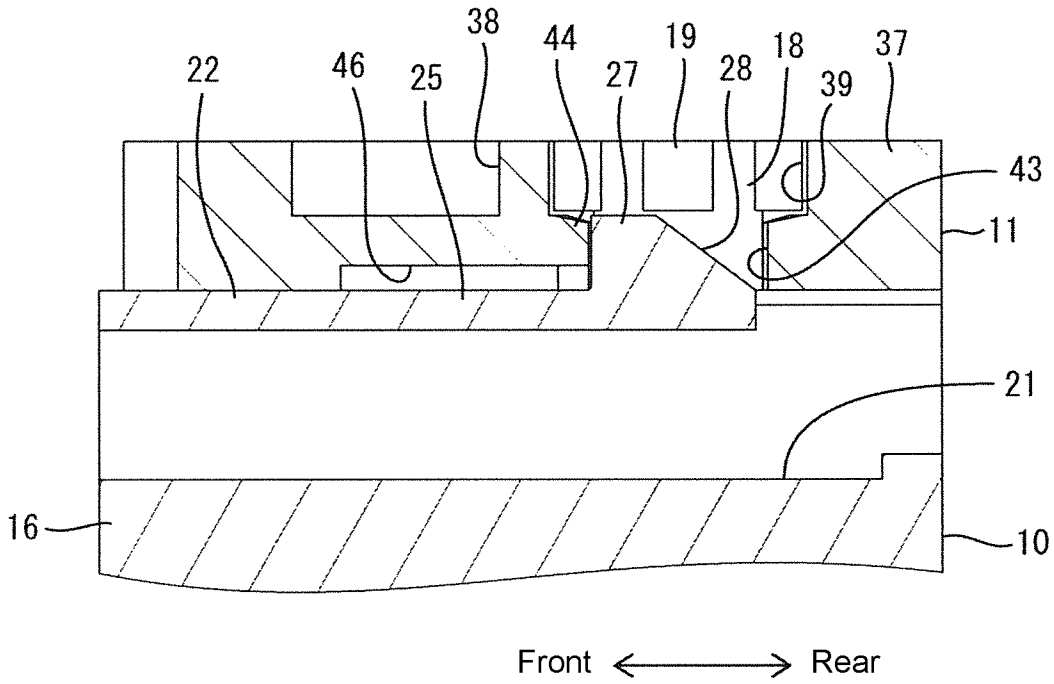
FIG. 3 is a section along X-X of FIG. 2.

When the operating member 11 reaches the initial position, the first lock 25 is displaced resiliently in a return direction and the lock projection 27 is inserted into the other end 43 of the long groove 39 from the guide groove 46 (see FIG. 3). The engaging edge 44 of the long groove 39 contacts the lock projection 27 from the front, thereby restricting the rotation of the operating member 11 in the return direction toward the assembled position. Further, the plate piece of the arm 37 on the other side (side where the resilient piece 48 is not provided) is stopped in contact with the rear end of the stopper 35, thereby restricting rotation of the operating member 11 beyond the initial position (see FIG. 4).

Figure 5:
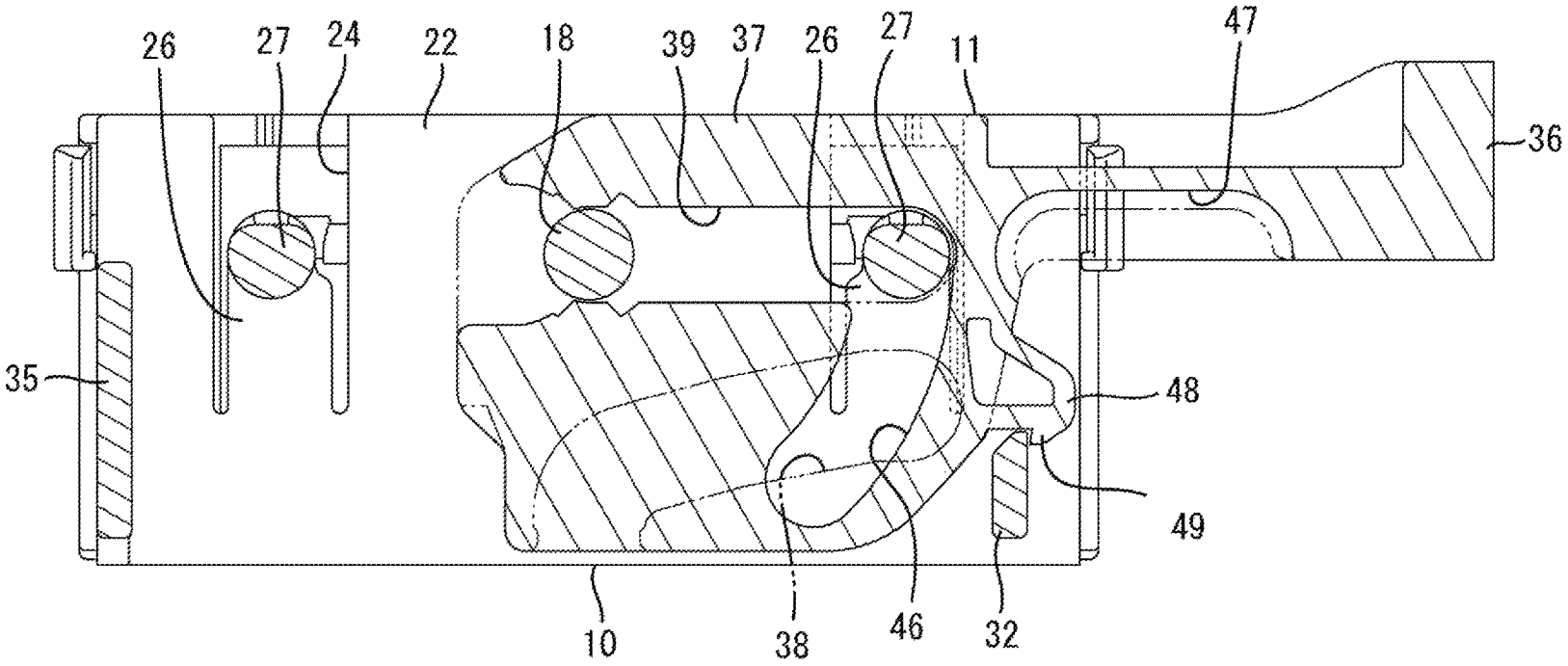
FIG. 5 is a section along Y-Y of FIG. 4.

Further, when the operating member 11 reaches the initial position, the locking projection 49 of the resilient piece 48 is arranged to come laterally into contact with the rear end of the rib-like part of the lock receiving portion 32, thereby restricting a movement of the operating member 11 from the initial position toward the connection position (see FIG. 5). At this time, the locking projection 49 of the resilient piece 48 is inserted into the insertion recess 34 at an inner side of the receiving piece 33 (see FIG. 4). In this way, the receiving piece 33 protects the locking projection 49 so that external mater cannot interfere with the locking projection 49 to inadvertently unlock the locking projection 49 from the lock receiving portion 32. Further, the support shafts 18 are kept inserted in the ends 41 of the long grooves 39 and are arranged to contact the ends 41 at the initial position. Thus, a movement of the operating member 11 away from the connection position also is restricted (see FIG. 2).

Figure 6:
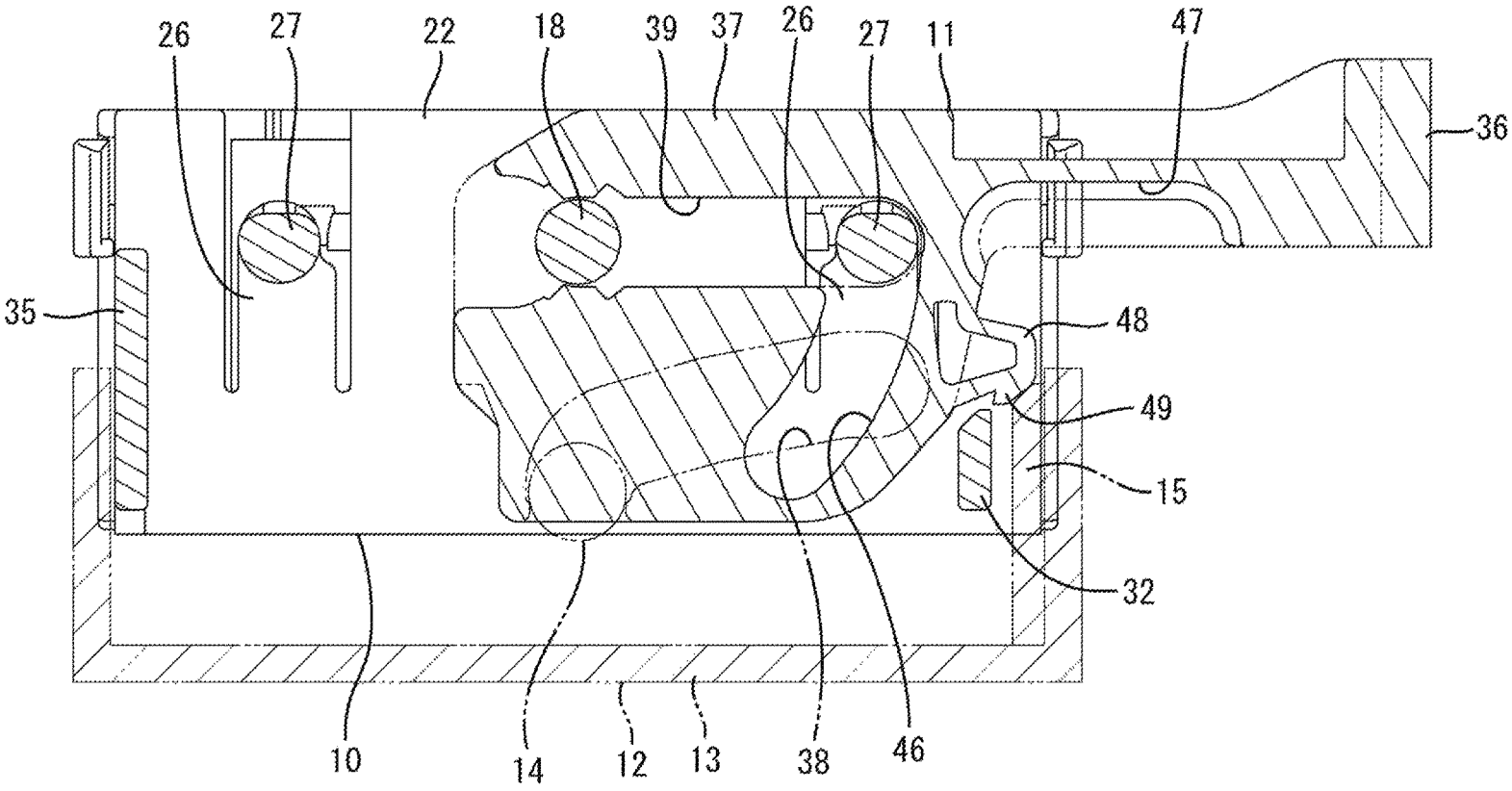
FIG. 6 is a view, corresponding to FIG. 5, showing a state where the mating housing is shallowly connected and a resilient piece and a lock receiving portion are unlocked by an unlocking portion of the mating housing.
Figure 7:
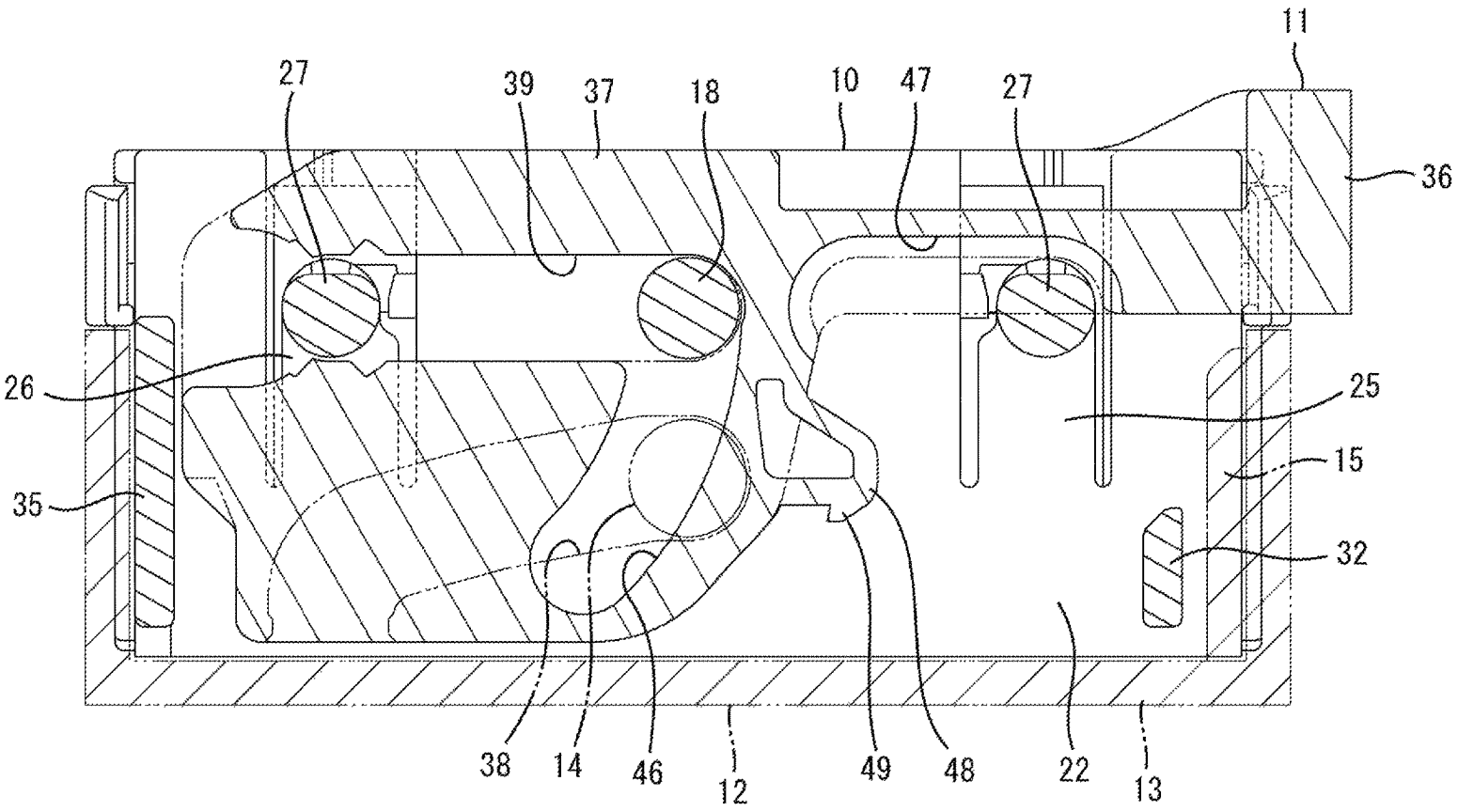
FIG. 7 is a view, corresponding to FIG. 5, showing a state where the operating member is arranged at a connection position with respect to the housing.

In the above state, the receptacle 13 of the mating housing 12 is fit shallowly to the housing 10 so that the cam followers 14 enter the cam grooves 38 (see FIG. 6). Further, the unlocking portion 15 presses the tip part of the resilient piece 48 in the projecting direction and deflects the resilient piece 48 to incline rearward while extending along a plate surface direction of the arm 37. In this way, the locking projection 49 is separated from the rib-like part of the receiving piece 32 to unlock the resilient piece 48 and the receiving piece 32 from each other and to enable the operating member 11 to be displaced to the connection position. Further, deflecting and deforming the resilient piece 48 along the inner surface of the receiving piece 33 avoids interference of the resilient piece 48 and the receiving piece 33.

Subsequently, the operating member 11 is moved linearly toward the connection position (side where the second lock 26 is located) along the first movement path. In an initial stage of the movement of the operating member 11 toward the connection position, the arm 37 slides on the lateral slope 28 of the lock projection 27 and the first lock 25 is deflected and deformed inward. When the operating member 11 is moved farther toward the connection position, the lock projection 27 enters the escaping groove 47 and escapes so that the first lock 25 returns resiliently to a natural state.

In the process of moving the operating member 11 along the first movement path, the support shafts 18 are displaced relative to the long grooves 39 in a direction away from the ends 41 and the jaws 19 at the front, and rear sides of the support shafts 18 slide in contact with the engaging edges 44 of the long grooves 39 from outside, thereby guiding a movement of the operating member 11. Further, in the process of moving the operating member 11, the cam followers 14 of the mating housing 12 slide in contact with the edges of the cam grooves 38, a cam mechanism acts between the operating member 11 and the mating housing 12 and the connecting operation of the housings 10, 12 proceeds with a low connecting force. During this time, the arms 37 of the operating member 11 may expand and deform out and away from the outer surfaces of the housing body 16 by receiving connection resistance. However, the engaging edges 44 of the long grooves 39 contact the front and rear jaws 19 from inside, thereby restricting expanding movements of the arms 37. As a result, the arms 37 cannot expand and detach from the housing 10.

In a stage immediately before the operating member 11 reaches the connection position, the tip of the arm 37 in a moving direction slides on the lateral slope 28 of the lock projection 27 of the second lock 26 and the second lock 26 deflects inward. When the operating member 11 reaches the connection position, the second lock 26 resiliently displaces in a return direction and the lock projection 27 is inserted into the end portion 41 of the long groove 39 from inside (see FIG. 8). At this time, the lock projection 27 contacts the end 41 of the long groove 39 in the lateral direction (moving direction along the first movement path), thereby restricting a movement of the operating member 11 in the return direction toward the initial position. Further, when the operating member 11 reaches the connection position, the support shafts 18 are arranged to contact the other end portions 43 of the long grooves 39 and the coupling 36 is arranged to contact the side surface of the housing 10, thereby restricting any further movement of the operating member 11 beyond the connection position. Furthermore, the lock projection 27 of the second lock 26 is arranged in the end 41 of the long groove 39 and the support shaft 18 is arranged in the other end 43 of the long groove 39, thereby restricting a rotational displacement of the operating member 11. At the connection position, the cam followers 14 are in final end parts of the cam grooves 38 and the housings 10, 12 are connected properly.

A situation may arise in which the operating member 11 cannot be moved along the first movement path due to an interfering object, such as a peripheral component, lateral to (right side of FIG. 2) the housing 10, and the coupling 36 or the like of the operating member 11 at the initial position may interfere with the interfering object. In this situation, the operating member 11 can be moved along the second movement path opposite to the first movement path.

In this case, the operating member 11 is inverted vertically and the coupling 36 is arranged to be on a side (left side of FIG. 9) opposite to that when the operating member 11 is moved along the first movement path with respect to the housing 10. First, the operating member 11 is assembled at the assembled position. At the assembled position, the lock projection 27 of the second lock 26 is inserted into the guide groove 46 of the arm 37 and contacts the front end of the guide groove 46 to restrict rotation of the operating member 11 in the direction opposite to that toward the initial position.

Subsequently, the operating member 11 is rotated in a counterclockwise direction about the support shafts 18 from the assembled position toward the initial position. When the operating member 11 reaches the initial position, the lock projection 27 of the second lock 26 is inserted resiliently into the other end 43 of the long groove 39 from inside and the engaging edge 44 of the long groove 39 contacts the lock projection 27 from the front, thereby restricting a return displacement of the operating member 11 to the assembled position. Further, the plate piece of the arm 37 on the other side (where the resilient piece 48 is not provided) is stopped in contact with the rear end of the stopper 35, thereby restricting further rotation of the operating member 11 beyond the initial position (see FIG. 9). Furthermore, the locking projection 49 of the resilient piece 48 locks the lock receiving portion 32 to restrict movement of the operating member 11 to the connection position. In this case, the locking projection 49 locks the lock receiving portion 32 on the lower surface (surface where the resilient locks 25, 26 are not provided) of the housing 10 on a side opposite to that when the first movement path is selected. Further, the stopper 35 to be stopped in contact with the arm 37 at the initial position is provided on the lower surface of the housing 10 when the first movement path is selected while being provided on the upper surface of the housing 10 when the second movement path is selected.

Subsequently, the housings 10, 12 are connected shallowly and the cam followers 14 enter the cam grooves 38. Then, the resilient piece 48 is pressed by the unlocking portion 15 and deflected and deformed rearward to move away from the lock receiving portion 32, thereby enabling the operating member 11 to be moved to the connection position. Subsequently, the operating member 11 is moved linearly toward the connection position (side where the first lock 25 is located) along the second movement path. When the operating member 11 reaches the connection position, the lock projection 27 of the first lock 25 is inserted resiliently into the end 41 of the long groove 39 from inside and contacts the end 41 of the long groove 39 in a direction opposite to the return direction to the initial position, thereby restricting a return movement of the operating member 11 to the initial position (see FIG. 10). Further, the lock projection 27 of the second lock 26 is inserted into the escaping groove 47 of the arm 37 and allowed to escape.

As just described, locking functions of the first and second locks 25, 26 at each of the initial position and the connection position are alternated when the operating member 11 is moved along the first movement path and when the operating member 11 is moved along the second movement path, but the locking functions themselves are the same.

Each of the following effects can be achieved by this embodiment.

The operating member 11 is rotated from the assembled position to the initial position and the laterally projecting amount of the housing 10 is suppressed more at the assembled position than at the initial position. Thus, the operating member 11 is less likely to interfere with external matter intruding to a lateral side of the housing 10 at the assembled position. On the other hand, since a transition is made from the rotating operation by the rotating mechanism to the linearly moving operation by the sliding mechanism at the initial position, the operating member 11 does not stay long at the initial position and is less likely to interfere with external matter also at the initial position. As a result, the operating member 11 is not likely to be moved inadvertently from the initial position to the connection position or broken due to interference with external matter.

Further, the arms 37 of the operating member 11 are not covered from outside by members such as conventional covers, but the expanding movements are suppressed by the contact of the engaging edges 44 of the long grooves 39 with the jaws 19 of the support shafts 18 to prevent detachment from the housing 10. Omitting the conventional covers avoids enlargement of the housing 10. This is ensured by arranging the operating member 11 exposed on the outer surfaces without being covered by the housing 10.

Further, the operating member 11 is moved linearly from the initial position to the connection position and either one of the first and second movement paths can be selected as the movement path to the connection position. Thus, the movement path of the operating member 11 can be determined depending on an installation situation and usefulness is enhanced. In addition, the locking means for keeping the operating member 11 at the initial position and the connection position are realized by the first lock 25 and the second lock 26 and four locking means corresponding to each movement path and each position are not provided. Thus, a structure can be simplified. In this case, members such as the conventional covers to cover the operating member 11 are not present on the outer surfaces of the housing 10. Therefore, a mold removal structure to mold the first and second locks 25, 26 on the outer surface of the housing 10 need not be complicated.

The engaging edges 44 of the long grooves 39 slide in contact with the support shafts 18 to guide a movement of the operating member 11. The long grooves 39 linearly guide a movement of the operating member 11, restrict a movement of the operating member 11 by being locked by the resilient locks 25, 26, and suppress opening deformation of the operating member 11 by causing the jaws 19 of the support shafts 18 to contact the engaging edges 44. Thus, as compared to the case where each function is provided individually, the structure of the operating member 11 can be simplified.

The resilient lock 25, 26 restricts a displacement of the operating member 11 in the direction opposite to that from the assembled position toward the initial position by locking the lock projection 27 to the front end part of the guide groove 46 when the operating member 11 is at the assembled position and restricts a displacement of the operating member 11 in the return direction from the initial position to the assembled position by locking the lock projection 27 to the other end 43 of the long groove 39 when the operating member 11 is at the initial position. Thus, the operating member 11 is locked and held to the resilient lock 25, 26 both at the initial position and at the assembled position and it is not necessary to provide the locking structure for each of the initial position and the assembled position so that the structure can be more simplified.

The unlocking portion 15 of the mating housing 12 presses the resilient piece 48 when the operating member 11 is at the initial position. Thus, the resilient piece 48 is deflected along the plate surface of the arm 37 to be unlocked from the lock receiving portion 32 and the operating member 11 can displace toward the connection position. In this case, a locking margin of the resilient piece 48 to the lock receiving portion 32 is determined in the direction along the plate surface of the arm 37, freedom in setting the locking margin is high and a sufficiently large locking margin can be set. As a result, the locking strength of the operating member 11 at the initial position can be enhanced.

Further, the resilient piece 48 is a beam supported on both ends coupled to the body of the arm 37, external matter such as a looped wire is less likely to be caught by the arm 37 and the deflection strength of the arm 37 can be enhanced.

Further, since the lock receiving portions 32 to be locked by the resilient piece 48 are provided on the outer surfaces of the housing 10 and members such as the conventional covers are not present on the outer surfaces of the housing 10, a mold removal structure in molding the lock receiving portions 32 needs not be complicated.

Other embodiments are briefly described below.

Contrary to the above embodiment, the support shafts may be provided on the inner surfaces of the arms of the operating member, the long grooves may be provided to be open in the outer surfaces of the housing and the support shafts may be inserted into the long grooves from outside to be slidable in contact with the long grooves.

The long grooves may have a bottomed shape.

The shape and the number of the jaws provided on the support shaft are arbitrary and the escaping recesses may be provided to correspond to the jaws.

Wires connected to the terminal fittings are pulled out rearwardly of the housing and a wire cover may be installed to cover the rear surface of the housing. The support shafts, the lock receiving portions and the resilient locks may be provided on the wire cover.

LIST OF REFERENCE SIGNS

10 . . . housing
11 . . . operating member
12 . . . mating housing
15 . . . unlocking portion
18 . . . support shaft
19 . . . jaw
25 . . . first lock
26 . . . second lock
27 . . . lock projection
32 . . . lock receiving portion
36 . . . coupling portion
37 . . . arm
38 . . . cam groove
39 . . . long groove
41 . . . end portion of long groove
44 . . . engaging edge portion
46 . . . guide groove
48 . . . resilient piece
49 . . . locking projection

What is claimed is:

1. An electrical connector, comprising:

a housing connectable to a mating housing, the housing having opposite first and second side surfaces and first and second support shafts projecting respectively from the first and second side surfaces, each of the support shafts having a plurality of circumferentially spaced jaws projecting out from the respective support shaft at a position spaced from the respective side surface; and an operating member including a coupling portion and first and second arms projecting from the coupling portion to define a U-shape that straddles the housing, the first and second arms of the operating member being formed respectively with first and second long linear grooves and escaping recesses extending from the long linear grooves, the escaping recesses being disposed and dimensioned to receive the jaws on the support shafts so that the long linear grooves can be engaged respectively with the first and second support shafts so that the operating member is linearly movable from an initial position to a connection position while the arms slide on the side surfaces of the housing and generate a cam action with the mating housing to urge the housing and the mating housing toward or away from one another, wherein each of the first and second long grooves includes an engaging edge engaged slidably between the respective side surface of the housing and the respective jaws of the respective support shaft to prevent deflection of the arms in an opening direction of the arms away from the housing in response to forces exerted on the operating member.

2. The electrical connector of claim 1, wherein the operating member is exposed on an outer surface of the housing without being covered.

3. The electrical connector of claim 1, wherein each of the support shafts has four jaws equally spaced from one another around a circumference of the respective support shaft.

4. The electrical connector of claim 1, wherein each of the arms further comprises a cam groove disposed to receive a cam follower on the mating housing to generate the cam action with the mating housing to urge the housing and the mating housing toward or away from one another.

5. The electrical connector of claim 4, wherein at least part of each of the cam grooves is curved.

6. The electrical connector of claim 1, wherein each of the arms has an inner surface slidably engaged with the housing and an outer surface facing away from the housing, each of the long linear grooves extends entirely through the respective arm from the inner surface to the outer surface thereof.

7. The electrical connector of claim 6, wherein each of the sidewalls includes at least one lock projection and wherein each of the arms of the operating member includes at least one guide groove extending into the inner surface of the respective arm and slidably engaged with one of the lock projections.

* * * * *